US009840982B2

(12) United States Patent
Shimoda et al.

(10) Patent No.: US 9,840,982 B2
(45) Date of Patent: Dec. 12, 2017

(54) SPRAY COATING FILM, ENGINE HAVING THE SPRAY COATING FILM AND FILM-FORMING METHOD OF THE SPRAY COATING FILM

(71) Applicant: TOYOTA JIDOSHA KABUSHIKI KAISHA, Toyota-shi, Aichi-ken (JP)

(72) Inventors: Kenji Shimoda, Nagoya (JP); Toshiaki Hamaguri, Toyota (JP); Kazuaki Nishio, Nissin (JP); Hiromichi Nakata, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 43 days.

(21) Appl. No.: 14/943,701

(22) Filed: Nov. 17, 2015

(65) Prior Publication Data

US 2016/0146148 A1 May 26, 2016

(30) Foreign Application Priority Data

Nov. 21, 2014 (JP) ..... 2014-236699

(51) Int. Cl.
*F02F 1/24* (2006.01)
*C23C 4/02* (2006.01)
(Continued)

(52) U.S. Cl.
CPC ..... *F02F 1/24* (2013.01); *C23C 4/02* (2013.01); *C23C 4/067* (2016.01); *C23C 4/11* (2016.01);
(Continued)

(58) Field of Classification Search
CPC ..... C23C 4/10; C23C 4/134; C23C 28/02; C23C 28/30; C23C 4/04; F02F 1/00; F02F 2001/008; F16J 9/26
See application file for complete search history.

(56) References Cited

U.S. PATENT DOCUMENTS 4,774,926 A * 10/1988 Adams ..... F02B 77/02 123/188.3
4,921,734 A * 5/1990 Thorpe ..... F02F 7/0087 123/193.2
5,014,664 A * 5/1991 Matsuoka ..... F02B 19/165 123/254
5,033,427 A * 7/1991 Kawamura ..... F02B 77/11 123/193.3
(Continued)

FOREIGN PATENT DOCUMENTS

CN 101063420 A 10/2007
CN 102925844 A 2/2013
(Continued)

OTHER PUBLICATIONS

Machine Translation of JP2013185200A.*
(Continued)

*Primary Examiner* — Long T Tran
(74) *Attorney, Agent, or Firm* — Oliff PLC

(57) ABSTRACT

A spray coating film has a first spray coating film formed on a surface of an aluminum substrate and a second spray coating film formed on a surface of the first spray coating film. In the first spray coating film, an inorganic material with a layered crystalline structure is dispersed in a Ni-based alloy material, and an area ratio of the inorganic material is in a range from 40% to 80% relative to the sectional area of the first spray coating film. The second spray coating film is a porous film composed of $ZrO_2$—$SiO_2$ based ceramic containing 30% to 50% by mass of $SiO_2$, and the second spray coating film has an area ratio of pores of 30% to 80% relative to the sectional area of the second spray coating film.

7 Claims, 9 Drawing Sheets

(51) Int. Cl.

| | |
|---|---|
| ***C23C 28/00*** | (2006.01) |
| ***F01L 3/04*** | (2006.01) |
| ***C23C 4/11*** | (2016.01) |
| ***C23C 4/067*** | (2016.01) |
| ***C23C 4/134*** | (2016.01) |

(52) U.S. Cl.
CPC ..... *C23C 4/134* (2016.01); *C23C 28/324* (2013.01); *C23C 28/3455* (2013.01); *F01L 3/04* (2013.01)

(56) References Cited

U.S. PATENT DOCUMENTS 5,097,807 A * 3/1992 Oikawa ..... F02B 23/0639 123/276
5,871,820 A * 2/1999 Hasz ..... C04B 35/62222 427/419.2
6,080,360 A * 6/2000 Pfeffinger ..... C23C 4/04 420/534
6,221,504 B1 * 4/2001 Pfeffinger ..... B22F 1/0096 428/558
7,191,770 B1 * 3/2007 Anderson ..... F02F 1/004 123/193.2
8,486,496 B2 * 7/2013 Ko ..... C23C 24/04 427/427
8,679,587 B2 * 3/2014 Chang ..... C23C 18/06 427/376.2
2008/0220234 A1 * 9/2008 Ko ..... C23C 24/04 428/220
2013/0062328 A1 3/2013 Shimoda et al.
2014/0290617 A1 10/2014 Tomita et al.

FOREIGN PATENT DOCUMENTS

| | | | |
|---|---|---|---|
| CN | 103155695 | A | 6/2013 |
| JP | S57-134562 | A | 8/1982 |
| JP | 2008-095595 | A | 4/2008 |
| JP | 2011-132561 | A | 7/2011 |
| JP | 2013-185200 | A | 9/2013 |
| JP | 2013-185201 | A | 9/2013 |
| JP | 2013-185202 | A | 9/2013 |
| WO | 2013/080389 | A1 | 6/2013 |

OTHER PUBLICATIONS

Machine Translation of JP57134562A.*
Apr. 15, 2016 Search Report issued in European Patent Application No. 15195672.9.
Zhu, Hui-chao et al., "Study on properties of ZrSi04 ceramic coatings by plasma spray," Journal of Guangdong Non-Ferrous Metals, vol. 15, No. 1, Mar. 2005, pgs. 30-32 (with English Abstract).

* cited by examiner

SPRAY COATING FILM, ENGINE HAVING THE SPRAY COATING FILM AND FILM-FORMING METHOD OF THE SPRAY COATING FILM

INCORPORATION BY REFERENCE

The disclosure of Japanese Patent Application No. 2014-236699 filed on Nov. 21, 2014 including the specification, drawings and abstract is incorporated herein by reference in its entirety.

BACKGROUND OF THE INVENTION

1. Field of the Invention

The invention relates to a heat-insulating spray coating film formed on a surface of an aluminum substrate, an engine having the spray coating film, and a film-forming method of the spray coating film.

2. Description of Related Art

For preventing heat from transferring to aluminum substrates, spray coating films with a heat insulating effect have always been formed on surfaces thereof. As the parts requiring such a heat insulating effect, for example, an engine can be mentioned.

In an engine, fuels combust in the combustion chamber, thus it is desired that combustion heat would not dissipate from the combustion chamber in order to improve combustion efficiency. What is important is to decrease the thermal conductivity of wall surfaces of the combustion chamber, i.e. to endow the wall surfaces thereof with a heat insulating effect.

In view of such a problem, for example, Publication of Japanese Patent No. 2013-185200 suggests a spray coating film having a first spray coating film formed on a surface of an aluminum substrate and a second spray coating film formed on a surface of the first spray coating film. The first spray coating film is a film composed of Ni—Cr alloy (Ni-based alloy), and the second spray coating film is a film in which SiO-based oxide is filled in pores of a sprayed porous oxide film including $ZrO_2$-containing particles.

In accordance with the spray coating film, heat insulation can be improved by including $ZrO_2$-containing particles in the second spray coating film. In addition, by filling the SiO-based oxide between the $ZrO_2$-containing particles, penetration of fuels into the second spray coating film can be prevented.

Nevertheless, in Publication of Japanese Patent No. 2013-185200, thermal conductivity of the second spray coating film is reduced by containing $ZrO_2$ in the second spray coating film, thereby the heat insulation of the second spray coating film is ensured. However, volumetric heat capacity of the second spray coating film would not be lowered sufficiently by only filling SiO-based oxide between the $ZrO_2$-containing particles. Hence, once the second spray coating film is heated, temperature of the second spray coating film would not be lowered sufficiently.

For example, when such a second spray coating film is formed on wall surfaces of a combustion chamber of an engine, temperature of the second spray coating film which serves as wall surfaces of the combustion chamber would rise immediately and thus explosion may occur, though heat insulation of the combustion chamber is ensured.

Further, in the case of the second spray coating film containing SiO-based oxide, thermal expansion ratio of the second spray coating film is excessively small in comparison with that of aluminum substrate. Consequently, thermal stress is generated due to difference in thermal expansion from the aluminum substrate. Even if a first spray coating film composed of Ni-based alloy is provided, the thermal stress cannot be absorbed sufficiently by the first spray coating film. As a result, the second spray coating film may peel off.

SUMMARY OF THE INVENTION

The invention provides a spray coating film which can avoid peeling of the spray coating film induced by thermal stress, and can allow elevated temperature of the spray coating film to decrease rapidly while maintaining heat insulation, and a film-forming method of the spray coating film.

The spray coating film involved in a first aspect of the invention is a spray coating film comprising a first spray coating film formed on a surface of an aluminum substrate and a second spray coating film formed on a surface of the first spray coating film, wherein, in the first spray coating film described above, an inorganic material with a layered crystalline structure is dispersed in a Ni-based alloy material, and an area ratio of the inorganic material is in a range from 40% to 80% relative to a sectional area of the first spray coating film; the second spray coating film is a porous film composed of $ZrO_2$—$SiO_2$ based ceramic containing 30% to 50% by mass of $SiO_2$, and the second spray coating film has an area ratio of pores of 30% to 80% relative to a sectional area of the second spray coating film.

Further, the film-forming method of the spray coating film involved in the second aspect of the invention is a film-forming method of a spray coating film having a first spray coating film formed on a surface of an aluminum substrate and a second spray coating film formed on a surface of the first spray coating film, characterized by including: a step of forming the first spray coating film by spray coating a surface of the aluminum substrate with a mixed powder, obtained by mixing an inorganic powder composed of an inorganic material with a layered crystalline structure and a Ni alloy powder composed of a Ni-based alloy material, in such a manner that an area ratio of the inorganic material is in a range of from 40% to 80% relative to the sectional area of the first spray coating film; and a step of forming the second spray coating film by spray coating a surface of the first spray coating film with a $ZrO_2$—$SiO_2$ powder composed of $ZrO_2$—$SiO_2$ based ceramic containing 30% to 50% by mass of $SiO_2$, in such a manner that the second spray coating film has an area ratio of pores of 30% to 80% relative to the sectional area of the second spray coating film.

In accordance with each aspect of the invention, peeling of the spray coating film induced by thermal stress can be avoided, and elevated temperature of the spray coating film can be decreased rapidly while maintaining heat insulation.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1A:
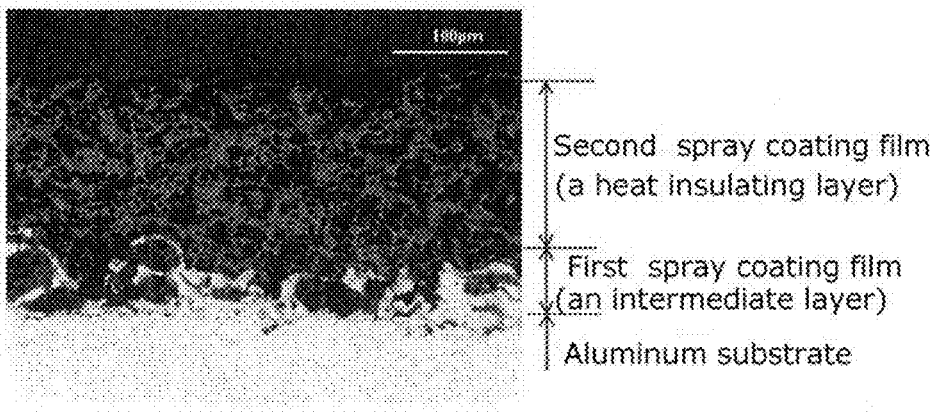
FIG. 1A is a cross-sectional photo illustrating an example of the spray coating film involved in an embodiment of the invention.
Figure 1B:
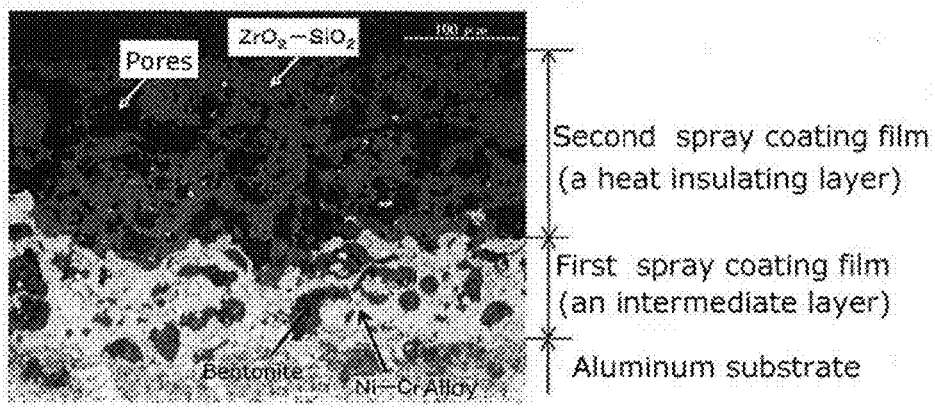
FIG. 1B is an enlarged photo illustrating the example of the spray coating film involved in the embodiment of the invention.

Hereinafter, embodiments of the invention will be described with reference to the drawings. FIG. 1A is a cross-sectional photo illustrating an example of the spray coating film involved in an embodiment of the invention, and FIG. 1B is an enlarged photo thereof. As shown in FIG. 1A, the spray coating film in this embodiment has a first spray coating film formed on a surface of an aluminum substrate and a second spray coating film formed on a surface of the first spray coating film. Herein, the second spray coating film functions as a heat insulating layer, and the first spray coating film functions as an intermediate layer for ensuring sealability between the aluminum substrate and the second spray coating film (heat insulating layer). Detailed content thereof is described below.

1. Aluminum Substrate

In the embodiment, the substrate coated with a spray coating film is a substrate made of aluminum alloy. For example, the aluminum alloy may be any one of aluminum alloy for deformation and aluminum alloy for casting.

As to aluminum alloy, Al—Cu based aluminum alloy, Al—Cu—Mg based aluminum alloy, Al—Cu—Mg—Ni based aluminum alloy, Al—Si based aluminum alloy, Al—Si—Mg based aluminum alloy, Al—Si—Cu—Mg based aluminum alloy, or the like can be mentioned. Said alloy may further include at least one element of Fe, Mn, Ti, Zn or the like.

2-1. First Spray Coating Film

As shown in FIG. 1B, the first spray coating film is a film coated on a surface of an aluminum substrate, and constitutes an intermediate layer between the aluminum substrate and a second spray coating film. In the first spray coating film, an inorganic material (bentonite) with a layered crystalline structure is dispersed in a Ni-based alloy material (Ni—Cr alloy material). In more detail, in the first spray coating film, the inorganic material with a layered crystalline structure is formed by becoming a dispersed phase in the first spray coating film, and the Ni-based alloy material becomes a matrix metal to bind the dispersed phases with each other. In order to enable the first spray coating film to function as an intermediate layer for ensuring sealability between the aluminum substrate and the second spray coating film (heat insulating layer), the first spray coating film has a thickness preferably in a range from 10 to 100 μm.

Herein, Ni—Cr alloy is used as the Ni-based alloy (material) in the embodiment, but the Ni-based alloy may also be materials, such as Ni—Al alloy, Ni—Cr—Al alloy and the like. When Ni—Cr alloy is used, 20% to 50% by mass of Cr is preferably contained. In this way, sealability with the aluminum substrate and oxidation resistance of the first spray coating film can be improved. In addition, when Ni—Al alloy is used, 4% to 20% by mass of Al is preferably contained. In this way, sealability with the aluminum substrate can be improved. Furthermore, when Ni—Cr—Al alloy is used, it preferably contains 18% to 22% by mass of Cr and 6% to 10% of Al.

However, heat insulating layers corresponding to the second spray coating film have always employed, for example, partially-stabilized $ZrO_2$ combined with $Y_2O_3$ (i.e. $ZrO_2$—$Y_2O_3$ based ceramic). In contrast, partially-stabilized $ZrO_2$ combined with $SiO_2$, i.e. $ZrO_2$—$SiO_2$ based ceramic (ceramic with zircon ($ZrSiO_4$) as a main component) is used in the embodiments, as described below.

In comparison with $ZrO_2$—$Y_2O_3$ based ceramic, $ZrO_2$—$SiO_2$ based ceramic has a smaller volumetric heat capacity, but a lower (about half of) thermal expansion ratio. Thus, when a second spray coating film of $ZrO_2$—$SiO_2$ based ceramic is employed, the difference in thermal expansion between the second spray coating film and the aluminum substrate tends to become greater compared with the previous spray coating films (second spray coating films made of $ZrO_2$—$Y_2O_3$ based ceramic). Thus, also for preventing the second spray coating film from peeling, it is important to decrease Young's modulus of the first spray coating film as the intermediate layer and to relieve the thermal stress acting on the interface with the second spray coating film.

Consequently, in this embodiment, bentonite (clay-like mineral, with $SiO_2$—$Al_2O_3$ as a main component) is used as the inorganic material with a layered crystalline structure to decrease the Young's modulus of the first spray coating film. Although bentonite is used in this embodiment, other inorganic materials such as graphite, mica or boron nitride (BN) may also be used, and two or more of those materials may be included.

Herein, "inorganic material with a layered crystalline structure" exemplified by bentonite, graphite, mica and boron nitride refers to a material prone to cracking in structure. For example, graphite has a layered structure of hexagonal plate-like crystal of hexagonal crystal system, in which carbons are linked with strong covalent bonds in the plane of each layer, but layers are combined with weak van der waals force. Hence, cracking between layers is prone to occur.

By dispersing the inorganic material with a layered crystalline structure in the first spray coating film, thermal stress, even if it is generated between the first spray coating film and the second spray coating film, can be relieved due to interlayer sliding of the inorganic material. As a result, peeling of the second spray coating film induced by thermal stress can be suppressed.

To achieve such an effect, an area ratio of the inorganic material in the first spray coating film ranges from 40% to 80% with respect to the sectional area of the first spray coating film. In this way, peeling of the second spray coating film and cracking of the first spray coating film described below can be avoided. From the experiments of the inventors which will be described below, it can be seen that the Young's modulus of the first spray coating film becomes excessively high in comparison with that of the second spray coating film and the second spray coating film is prone to peeling when the area ratio of the inorganic material is less than 40%. On the other hand, when the area ratio of the inorganic material exceeds 80%, the matrix metal (Ni-based alloy material) of the first spray coating film becomes less, and therefore mechanical strength of the first spray coating film decreases.

2-2. Film-Forming Step of a First Spray Coating Film

In formation of the first spray coating film, an inorganic powder (e.g. bentonite powder) composed of the aforementioned inorganic material with a layered crystalline structure and Ni alloy powder (e.g. Ni—Cr powder) composed of the aforementioned Ni-based alloy material, which constitute raw materials of the first spray coating film, are prepared first.

Next, a mixed powder is made by mixing the inorganic powder and the Ni alloy powder in such a manner that the inorganic material is uniformly dispersed in the first spray coating film. The mixing ratio of the inorganic powder to the Ni alloy powder is a ratio such that an area ratio of the inorganic material ranges from 40% to 80% relative to the sectional area of the first spray coating film in the case of film forming, and this ratio can be set by conducting specific experiments or the like. For example, in the case of bentonite particles, they are contained in an amount of 20% to 50% by mass with respect to the mixed powder; and in the case of graphite particles, they are contained in an amount of 16% to 40% by mass with respect to the mixed powder.

Preferably, the Ni alloy powder has an average particle size ranging from 20 μm to 30 μm, and an average particle size of the inorganic particles ranges from 20 μm to 30 μm. It should be noted that, the average particle size recited in the specification refers to an average particle size measured according to a method based on JISZ8901.

The resultant mixed powder is sprayed to an aluminum substrate by spray coating while being molten. It should be noted that, prior to the formation of the first spray coating film, the surface of the aluminum substrate can be roughened by sandblasting or the like in order to ensure sealability between the first spray coating film and the substrate. As to the spray coating methods, plasma spray coating method such as atmospheric-pressure plasma spray coating method and reduced-pressure plasma spray coating method, powder flame spray coating method, high-speed flame spray coating method or the like can be mentioned. The spray coating method is not particularly restricted as long as it can melt at least the Ni alloy powder in the mixed powder to result in formation of the first spray coating film on the aluminum substrate.

Figure 2:
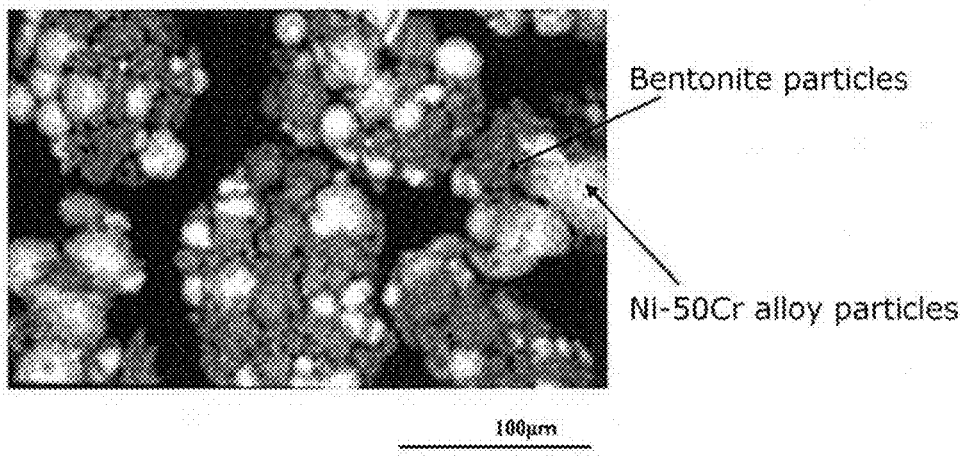
FIG. 2 is a photo of granulation powder used for forming the first spray coating film.

Here, after the inorganic powder and the Ni alloy powder are mixed, e.g. as shown in FIG. 2, inorganic particles that constitute the inorganic powder and Ni alloy particles that constitute the Ni alloy powder can be sintered for granulation. By allowing the mixed powder to employ such granulation powder, the inorganic material can be dispersed in the first spray coating film more uniformly.

FIG. 2 is a photo of the granulation powder used for forming the first spray coating film. A granulation powder having an average particle size of 70 μm is formed by mixing bentonite particles (inorganic particles) with a particle size of 45 μm or less in a Ni-50Cr alloy powder having a particle size ranging from 10 μm to 45 μm and an average particle size of 20 μm, and then granulating via sintering. It should be noted that, the mixing ratio by mass of the Ni-50Cr alloy powder to the bentonite particles is 65:35. Thereby, an area ratio of bentonite in the obtained first spray coating film is 60% relative to the sectional area of the first spray coating film (for example, with reference to Example 1, which will be described below).

3-1. Second Spray Coating Film

As shown in FIG. 1B, the second spray coating film is a film coated on a surface of the first spray coating film, which is a film functioning as a heat insulating layer for insulating heat transferred to an aluminum substrate or heat from the aluminum substrate. The second spray coating film is a film composed of $ZrO_2$—$SiO_2$ based ceramic (with zircon ($ZrSiO_4$) as a main component) containing 30% to 50% by mass of $SiO_2$. The second spray coating film is a porous film having an area ratio of pores ranging from 30% to 80% relative to the sectional area of the second spray coating film.

Nevertheless, thermal conductivity $\lambda$ can be represented by the following formula (1): $\lambda=\rho\cdot Cp\cdot\alpha$ (1), wherein $\rho$ is density, Cp is specific heat, $\alpha$ is thermal diffusivity, and $\rho\cdot Cp$ is volumetric heat capacity.

Here, if thermal conductivity is decreased, heat insulation of the second spray coating film increases, and if volumetric heat capacity is decreased, surface temperature of the second spray coating film can be decreased rapidly. For decreasing volumetric heat capacity, it is efficient to use materials with low density (specific gravity).

So far, partially-stabilized $ZrO_2$ combined with $Y_2O_3$, MgO, CaO or the like has always been employed. In this embodiment, partially-stabilized $ZrO_2$ combined with $SiO_2$, i.e. $ZrO_2$—$SiO_2$ based ceramic, is used. Since $SiO_2$ has a lower specific gravity (about one third) than that of $Y_2O_3$, MgO, CaO or the like, it can decrease the density of the second spray coating film, and is efficient to decrease the volumetric heat capacity of the second spray coating film. In this way, even if temperature of the second spray coating film rises, it can be lowered rapidly.

The $ZrO_2$—$SiO_2$ based ceramic involved in the embodiment herein refers to ceramic with zircon ($ZrSiO_4$) as a main component. The $ZrO_2$—$SiO_2$ based ceramic is a material in which the content of $ZrO_2$—$SiO_2$ is 98% by mass or more on the premise of 30% to 50% by mass of $SiO_2$ being contained, and may further contain $Al_2O_3$, $TiO_2$, $Fe_2O_3$, etc.

By containing 30% to 50% by mass of $SiO_2$ in the second spray coating film, volumetric heat capacity of the second spray coating film can be decreased without cracking of the second spray coating film, and temperature of the second spray coating film can be lowered rapidly. From the experiments of the inventors described below, it can be seen that volumetric heat capacity of the second spray coating film becomes greater and desired heat insulation and the like cannot be obtained if the content of $SiO_2$ is less than 30% by mass. On the other hand, cracking of the second spray coating film occurs sometimes if the content of $SiO_2$ exceeds 50% by mass.

In addition, by allowing the pores in the second spray coating film to have an area ratio of 30% to 80% relative to the sectional area of the second spray coating film, heat insulation of the second spray coating film can be improved while ensuring mechanical strength thereof. Here, from the experiments of the inventors described below, it can be seen that thermal conductivity of the second spray coating film becomes higher and volumetric heat capacity thereof become greater when the second spray coating film has an area ratio of the pores less than 30%. On the other hand, cracking of the second spray coating film occurs sometimes when the area ratio of the pores in the second spray coating film exceeds 80%.

In this way, the second spray coating film employs low-density $ZrO_2$—$SiO_2$ as a material, and is porosified in structure, such that both low thermal conductivity and low volumetric heat capacity can be achieved compared with the past.

3-2. Film-Forming Step of a Second Spray Coating Film

In formation of the second spray coating film, a $ZrO_2$—$SiO_2$ powder composed of $ZrO_2$—$SiO_2$ based ceramic containing 30% to 50% by mass of $SiO_2$, which constitute a raw material of the second spray coating film, is prepared first. The $ZrO_2$—$SiO_2$ powder herein may be a powder obtained by pulverizing mineral of zircon and then subjecting to classification, or may be a powder obtained by melting $ZrO_2$ and $SiO_2$ via electro-fusion method, solidifying it, pulverizing the solidified material and then subjecting to classification.

The $ZrO_2$—$SiO_2$ powder is preferably in a range from 1 μm to 10 μm, and it may be a powder obtained by sintering particles having an average particle size of 1 μm or less and then subjecting to granulation. Under any circumstance, borders (grain boundaries) between grain boundaries of the second spray coating film can be increased and thermal diffusivity of the second spray coating film can be suppressed by refining the $ZrO_2$—$SiO_2$ powder to increase the specific surface thereof. Moreover, the pores formed in the second spray coating film is more finely dispersed (refined) by refining the $ZrO_2$—$SiO_2$ powder, and thus thermal diffusivity of the second spray coating film can be further suppressed.

4. Application to a Cylinder Head of an Engine

Figure 3:
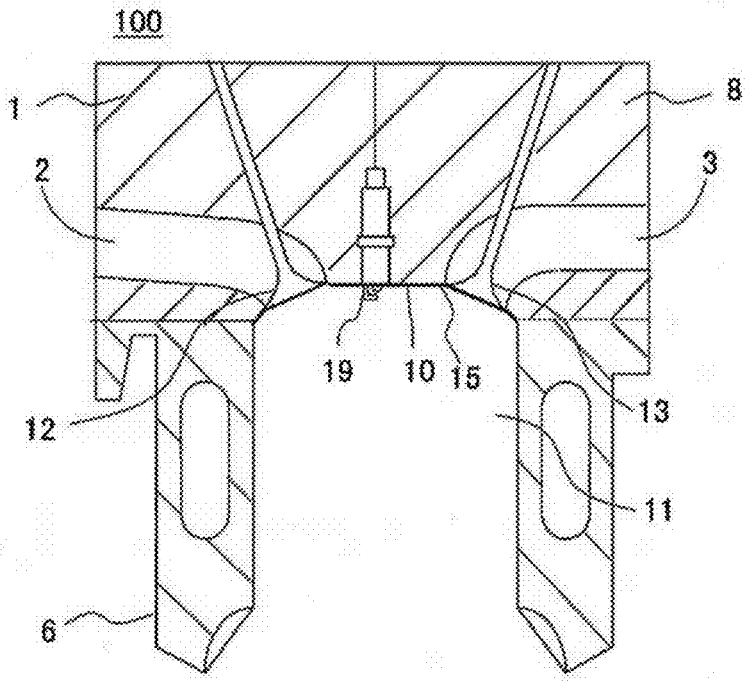
FIG. 3 is diagram of an example for illustrating application of the spray coating film involved in an embodiment to a cylinder head of an engine.
Figure 4:
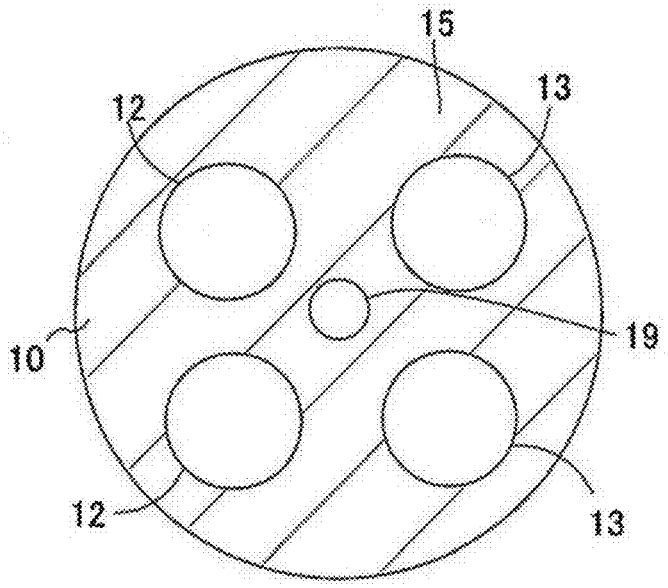
FIG. 4 is schematic top view of a wall surface of a combustion chamber of the cylinder head shown in FIG. 3.

FIG. 3 is a graph illustrating application of a spray coating film 10 involved in an embodiment to a cylinder head 1 of an engine 100. FIG. 4 is a schematic top view of a wall surface 15 of a combustion chamber 11 of the cylinder head 1 shown in FIG. 3. At first, as an aluminum substrate of the embodiment, for example, the cylinder head 1 of aluminum alloy for casting is prepared. The cylinder head 1 configured on upper portion of a cylinder body 6 is formed with a intake port 2 and an exhaust port 3, and provided with two sets of intake valves 12 and exhaust valves 13, with a spark plug 19 arranged at the center thereof.

In this embodiment, a spray coating film 10 composed of a first spray coating film and a second spray coating film is formed on the wall surface 15 of the cylinder head 1 that forms the combustion chamber 11. Specifically, in the combustion chamber 11 of the cylinder head 1, the spray coating film 10 is formed on the wall surface 15 of the combustion chamber 11 that is provided with intake valves 12 and exhaust valves 13, as shown in FIG. 3 and FIG. 4, by for example plasma spray coating in the order of the first spray coating film and then the second spray coating film. In this way, the engine 100 with the spray coating film 10 can improve heat insulation of the combustion chamber 11, and can lower temperature of the wall surface of the combustion chamber 11 rapidly.

Examples of the invention will be described below.

Example 1

Figure 6A:
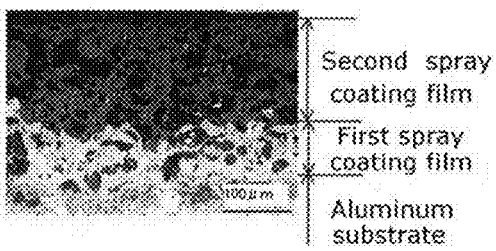
FIG. 6A is a cross-sectional photo of the spray coating film involved in Example 1.

A cylinder head of an engine made of an aluminum alloy (JIS standard: AC4D) (aluminum substrate) was prepared (with reference to FIG. 3 and FIG. 4). A spray coating film composed of a first spray coating film (an intermediate layer) and a second spray coating film (a heat insulating layer) was formed on the wall surface of the cylinder head that forms a combustion chamber (with reference to FIG. 6A).

[The Film-Forming Step of the First Spray Coating Film (Intermediate Layer)]

Specifically, as an inorganic powder composed of an inorganic material with a layered crystalline structure, bentonite powder (spray-granulated powder having an average particle size of 45 μm or less) was prepared; and as an Ni-alloy powder composed of Ni alloy, Ni-50Cr alloy powder (gas-atomized powder having an particle size in a range of 10 μm to 45 μm and an average particle size of 20 μm) was prepared. It should be noted that, Ni-50Cr alloy refers to an alloy of Ni containing 50% by mass of Cr.

Next, a mixed powder was prepared by mixing the Ni-50Cr alloy powder and bentonite powder at a ratio of 65% by mass:35% by mass in such a manner that the area ratio of bentonite was 60% relative to the sectional area of the first spray coating film in formation of the first spray coating film. Subsequently, a granulation powder (with an average particle size of 70 μm) was prepared by granulation of the bentonite particles that constitute the bentonite powder and the Ni-50Cr alloy particles that constitute the Ni-50Cr alloy powder (with reference to FIG. 2).

Next, the wall surface of the cylinder head that forms the combustion chamber (surface of the aluminum substrate) was subjected to shot blasting, and the wall surface was roughened in such a manner that the surface roughness of the wall surface became a center line average roughness Ra of 7 μm.

Subsequently, the aforementioned granulation powder was sprayed to the roughened wall surface that forms the combustion chamber by plasma spray coating using a plasma spray coating apparatus (F4 gun manufactured by METCO), thereby forming the first spray coating film. Specifically, the first spray coating film with a film thickness of 50 μm was formed under the conditions of: using Ar—$H_2$ gas, in which argon (at a flow rate of 20 L/min) was mixed with hydrogen gas (at a flow rate of 8 L/min), as the plasma gas; a plasma current of 450 A; a plasma voltage of 60 V; a powder supply amount of 30 g/min, and a spraying distance of 150 mm. As a result, the first spray coating film having an area ratio of bentonite of 60% relative to the sectional area of the first spray coating film was obtained. It should be noted that, the area ratios of inorganic material (bentonite) shown in Table 1 are values measured through binarization of image of the cross section in the film thickness direction of the first spray coating film.

[Film-Forming Step of a Second Spray Coating Film (Heat Insulating Layer)]

Figure 5A:
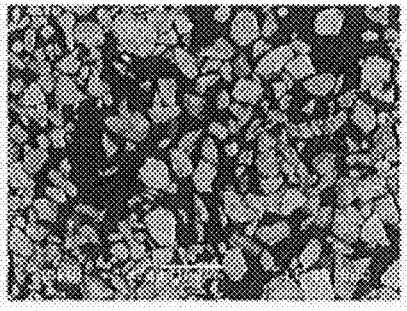
FIG. 5A is a photo of $ZrO_2$—$SiO_2$ powder involved in Example 1.

Pulverized powder (with a particle size ranging from 10 μm to 45 μm and an average particle size of 20 μm) of zircon sand ($ZrO_2$-33$SiO_2$-0.7$Al_2O_3$-0.15$TiO_2$-0.1$Fe_2O_3$) was prepared as the $ZrO_2$—$SiO_2$ powder composed of $ZrO_2$—$SiO_2$ based ceramic containing 33% by mass of $SiO_2$ (with reference to FIG. 5A).

Subsequently, the second spray coating film was formed using a same plasma spray coating apparatus (F4 gun manufactured by METCO) as that in the formation of the first spray coating film. Specifically, the aforementioned $ZrO_2$—$SiO_2$ powder was sprayed to a surface of the first spray coating film by plasma spray coating, thereby to form a second spray coating film in such a manner that the second spray coating film had an area ratio of pores of 60% relative to the sectional area of the second spray coating film. It should be noted that, the area ratios of pores shown in Table 1 are values measured through binarization of image of the cross section in film thickness direction of the second spray coating film (with reference to FIG. 6A).

Here, the second spray coating film was formed under the conditions of: using Ar—$H_2$ gas, in which argon (at a flow rate of 40 L/min) was mixed with hydrogen gas (at a flow rate of 12 L/min), as the plasma gas; a plasma current of 600 A; a plasma voltage of 60 V; a powder supply amount of 20 g/min, and a spraying distance of 100 mm. Moreover, the second spray coating film was subjected to fine grinding in a manner that the spray coating film after film formation has a thickness of 150 μm (specifically, the second spray coating film has a film thickness of 100 μm), and the surface roughness of the second spray coating film became a center line average roughness Ra of 2 μm.

Example 2

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that the following powder was used in the film-forming step of the first spray coating film, i.e. a powder obtained by mixing Ni-50Cr alloy powder with bentonite powder at a ratio of 80% by mass:20% by mass in such a manner that the area ratio of bentonite was 40% relative to the sectional area of the first spray coating film, and granulating the mixture via sintering.

Example 3

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that the following powder was used in the film-forming step of the first spray coating film, i.e. a powder obtained by mixing Ni-50Cr alloy powder with bentonite powder at a ratio of 50% by mass:50% by mass in such a manner that the area ratio of bentonite was 80% relative to the sectional area of the first spray coating film, and granulating the mixture via sintering.

Example 4

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that a $ZrO_2$—$SiO_2$ powder composed of $ZrO_2$—$SiO_2$ ceramic containing 50% by mass of $SiO_2$ was used to form the second spray coating film in the step of forming the second spray coating film. Consequently, the second spray coating film formed contains 50% by mass of $SiO_2$. It should be noted that, the $ZrO_2$—$SiO_2$ powder used herein was a powder with a particle size in a range from 10 μm to 45 μm and an average particle size of 20 μm, which was obtained by adding 50% by mass of $SiO_2$ to $ZrO_2$, melting it via electro-fusion method, solidifying, pulverizing the solidified material and then subjecting to classification.

Example 5

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that Ni-20Cr alloy powder (gas-atomized powder having a particle size of 10 μm to 45 μm and an average particle size of 20 μm) was used instead of Ni-50Cr alloy powder as the Ni alloy powder composed of Ni alloy in the film-forming step of the first spray coating film.

Example 6

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that graphite powder was used instead of the bentonite powder in the film-forming step of the first spray coating film. It should be noted that, in this example, after Ni-50Cr alloy powder and the graphite powder were mixed at a ratio of 72% by mass:28% by mass in such a manner that the area ratio of graphite was 60% relative to the sectional area of the first spray coating film, the mixture was granulated via sintering.

Example 7

Figure 5B:
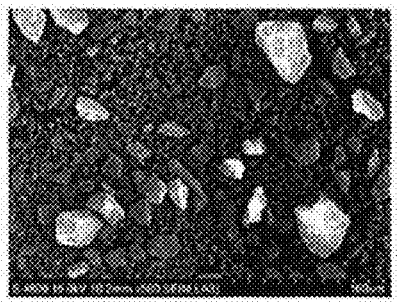
FIG. 5B is a photo of $ZrO_2$—$SiO_2$ powder involved in Example 7.

A spray coating film composed of a first spray coating film (intermediate layer) and a second spray coating film (a heat insulating layer) was formed on the wall surface of a cylinder head made of aluminum alloy that forms a combustion chamber in the same manner as in Example 1, except that a zircon sand powder ($ZrO_2$—$SiO_2$ powder) having an average particle size of 7 μm (with reference to FIG. 5B) was used to form the second spray coating film in the film-forming step of the second spray coating film. It should be noted that, in the second spray coating film involved in Example 7, the second spray coating film has an area ratio of pores of 40% relative to the sectional area of the second spray coating film (with reference to FIG. 6B), as shown in Table 1.

Example 8

Figure 5C:
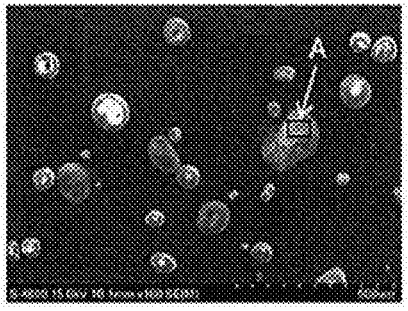
FIG. 5C is a photo of $ZrO_2$—$SiO_2$ powder involved in Example 8.
Figure 5D:
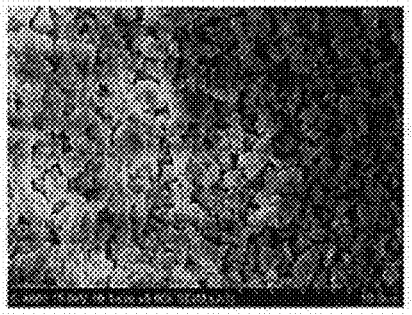
FIG. 5D is an enlarged photo of portion A in FIG. 5C.

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that a zircon sand powder ($ZrO_2$—$SiO_2$ powder) (with reference to FIG. 5C and FIG. 5D) obtained by granulating $ZrO_2$—$SiO_2$ particles having an average particle size of 1 μm or less via sintering was used to form the second spray coating film in the film-forming step of the second spray coating film. It should be noted that, in the second spray coating film involved in Example 8, the second spray coating film has an area ratio of pores of 40% relative to the sectional area of the second spray coating film (FIG. 6C), as shown in Table 1.

Comparative Example 1

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that in the film-forming step of the first spray coating film, bentonite powder was not used, but the first spray coating film was formed of only Ni-50Cr alloy powder; and in the film-forming step of the second spray coating film, a powder with $ZrO_2$-$8Y_2O_3$ as a main component was used instead of the zircon sand powder ($ZrO_2$—$SiO_2$ powder) with $ZrO_2$-$33SiO_2$ as a main component. It should be noted that, the second spray coating film has an area ratio of pores of 20% relative to the sectional area of the second spray coating film (with reference to FIG. 6D).

Comparative Example 2

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that bentonite powder was not used, but the first spray coating film was formed of only Ni-50Cr alloy powder.

Comparative Example 3

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that the following powder was used in the film-forming step of the first spray coating film, i.e. a powder obtained by mixing Ni-50Cr alloy powder with bentonite powder at a ratio of 85% by mass:15% by mass in such a manner that the area ratio of bentonite was 30% relative to the sectional area of the first spray coating film, and then granulating the mixture via sintering.

Comparative Example 4

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that the following powder was used in the film-forming step of the first spray coating film, i.e. a powder obtained by mixing Ni-50Cr alloy powder with bentonite powder at a ratio of 40% by mass:60% by mass in such a manner that the area ratio of bentonite was 90% relative to the sectional area of the first spray coating film, and then granulating the mixture via sintering.

Comparative Example 5

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that a $ZrO_2$—$SiO_2$ powder taking $ZrO_2$—$SiO_2$ as a main component and containing 20% by mass of $SiO_2$ was used to form the second spray coating film in the step of forming the second spray coating film.

Comparative Example 6

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that a $ZrO_2$—$SiO_2$ powder taking $ZrO_2$—$SiO_2$ as a main component and containing 60% by mass of $SiO_2$ was used to form the second spray coating film in the step of forming the second spray coating film.

Comparative Example 7

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that the spraying conditions such as the amount of hydrogen gas mixed in the Ar—$H_2$ gas that serves as plasma gas, the plasma current, and the plasma voltage were changed in the film-forming step of the second spray coating film, such that the second spray coating film had an area ratio of pores of 25% relative to the sectional area of the second spray coating film.

Comparative Example 8

A spray coating film composed of a first spray coating film (an intermediate layer) and a second spray coating film (a heat insulating layer) was formed on the wall surface of a cylinder head made of aluminum alloy that forms a combustion chamber in the same manner as in Example 1, except that the spraying conditions such as the amount of hydrogen gas mixed in the Ar—$H_2$ gas that serves as plasma gas, the plasma current, and the plasma voltage were changed in the step of forming the second spray coating film, such that the second spray coating film had an area ratio of pores of 85% relative to the sectional area of the second spray coating film.

(Tests for Determining Engine Efficiency)

Temperature around the cylinder head was measured using the cylinder heads involved in Examples 1-8 and Comparative Examples 1-8 at an engine speed of 2000 rpm, thereby to determine the engine efficiency. The results thereof are shown in Table 1. It should be noted that, the engine efficiency shown in Table 1 refers to reduced ratio of cooling loss of an engine (cooling loss reduction ratio) in comparison with a cylinder head not provided with a spray coating film. The higher the engine efficiency is, the higher the heat insulation of the cylinder head is. In addition, peeling and cracking (durability) of the first and second spray coating films as the spray coating film were identified after said tests. The results thereof are shown in Table 1.

TABLE 1

| | First Spray Coating Film (Intermediate Layer) | | | Second Spray Coating Film (heat Insulating Layer) | | | |
|---|---|---|---|---|---|---|---|
| | Ni Alloy Composition | Inorganic Material | Area Ratio (%) | Composition | Area Ratio of Pores (%) | Engine Efficiency (%) | Durability |
| Example 1 | Ni—50Cr | Bentonite | 60 | $ZrO_2$—$33SiO_2$ | 60 | 10 | No peeling·cracking |
| Example 2 | Ni—50Cr | Bentonite | 40 | $ZrO_2$—$33SiO_2$ | 60 | 10 | No peeling·cracking |
| Example 3 | Ni—50Cr | Bentonite | 80 | $ZrO_2$—$33SiO_2$ | 60 | 10 | No peeling·cracking |
| Example 4 | Ni—50Cr | Bentonite | 60 | $ZrO_2$—$50SiO_2$ | 60 | 10 | No peeling·cracking |
| Example 5 | Ni—20Cr | Bentonite | 60 | $ZrO_2$—$33SiO_2$ | 60 | 10 | No peeling·cracking |
| Example 6 | Ni—50Cr | Graphite | 60 | $ZrO_2$—$33SiO_2$ | 60 | 10 | No peeling·cracking |
| Example 7 | Ni—50Cr | Bentonite | 60 | $ZrO_2$—$33SiO_2$ | 40 | 12 | No peeling·cracking |
| Example 8 | Ni—50Cr | Bentonite | 60 | $ZrO_2$—$33SiO_2$ | 40 | 14 | No peeling·cracking |
| Comparative Example 1 | Ni—50Cr | No | — | $ZrO_2$—$8Y_2O_3$ | 20 | 5 | No peeling·cracking |
| Comparative Example 2 | Ni—50Cr | No | — | $ZrO_2$—$33SiO_2$ | 60 | 10 | Peeling of the second spray coating film |
| Comparative Example 3 | Ni—50Cr | Bentonite | 30 | $ZrO_2$—$33SiO_2$ | 60 | 10 | Peeling of the second spray coating film |
| Comparative Example 4 | Ni—50Cr | Bentonite | 90 | $ZrO_2$—$33SiO_2$ | 60 | 10 | Cracking of the first spray coating film |
| Comparative Example 5 | Ni—50Cr | Bentonite | 60 | $ZrO_2$—$20SiO_2$ | 60 | 6 | No peeling·cracking |
| Comparative Example 6 | Ni—50Cr | Bentonite | 60 | $ZrO_2$—$60SiO_2$ | 60 | 9 | Cracking of the second spray coating film |
| Comparative Example 7 | Ni—50Cr | Bentonite | 60 | $ZrO_2$—$33SiO_2$ | 25 | 6 | No crazing·cracking |
| Comparative Example 8 | Ni—50Cr | Bentonite | 60 | $ZrO_2$—$33SiO_2$ | 85 | 9 | Cracking of the second spray coating film |

[Result 1]

As shown in Table 1, for the cylinder heads involved in Examples 1-8, the engine efficiency was 10% or more, and peeling and cracking of the first spray coating film and the second spray coating films did not occur. However, for the cylinder heads involved in Comparative Examples 1-8, it was confirmed that the engine efficiency thereof were lower, or durability of the spray coating films was decreased in comparison with the cylinder heads involved in Examples 1-8. Detailed contents were described below.

[Result 1-1]

In terms of composition of the second spray coating film, the cylinder head involved in Comparative Example 1 was different from the other cylinder heads, and detonation occurred. It is believed that this is due to the fact that $ZrO_2$—$Y_2O_3$ based ceramic that constitutes the second spray coating film of the cylinder head involved in Comparative Example 1 has a higher specific gravity and a greater volumetric heat capacity than $ZrO_2$—$SiO_2$ based ceramic that constitutes the second spray coating film of the cylinder heads involved in Examples 1-8.

[Result 1-2]

In terms of the inorganic material of the first spray coating film, the second spray coating films of the cylinder heads involved in Comparative Examples 2 and 3 peeled off. It is believed that this is induced by thermal stress generated between the first spray coating film and second spray coating films of the cylinder heads involved in Comparative Examples 2 and 3.

That is, it is believed that the first spray coating film involved in Comparative Example 2 was different from those involved in Examples 1-8, because the inorganic material with a layered crystalline structure (a material prone to cracking) contains no bentonite or graphite, the thermal stress between the first spray coating film and second spray coating films cannot be relieved. Here, it is believed that the first spray coating film (intermediate layer)

involved in Comparative Example 2 has a coefficient of thermal expansion between that of the aluminum substrate and that of the second spray coating film, but the Young's modulus of the first spray coating film is higher than that of the second spray coating film, thus peeling of the second spray coating film occurs. This will be confirmed in Confirming Test 1 described below.

In addition, in the first spray coating film of Comparative Example 3, the area ratio of bentonite relative to the sectional area of the first spray coating film is less than 40% (in particular, 30%). Therefore, the effect of relieving the thermal stress between the first spray coating film and the second spray coating film via bentonite cannot be expected sufficiently.

It should be noted that, for the first spray coating film involved in Comparative Example 1, the inorganic material with a layered crystalline structure (a material prone to cracking) did not contain bentonite or graphite. However, different from Comparative Examples 2 and 3, the second spray coating film involved in Comparative Example 1 did not peel off. It is believed that this is due to the fact that $ZrO_2$—$Y_2O_3$ has a coefficient of thermal expansion about two times of that of $ZrO_2$—$SiO_2$. Namely, it is believed that in comparison with the coefficient of thermal expansion of $ZrO_2$—$SiO_2$, the coefficient of thermal expansion of $ZrO_2$—$Y_2O_3$ of the first spray coating film involved in Comparative Example 1 is closer to the coefficients of thermal expansion of the first spray coating film and the aluminum substrate, and therefore it is difficult to generate thermal stress between the first spray coating film and second spray coating film.

On the other hand, cracking of the first spray coating film occurred in the cylinder head of Comparative Example 4. It is believed that because the area ratio of bentonite in the first spray coating film of Comparative Example 4 exceeds 80% (in particular, 85%) relative to the sectional area of the first spray coating film, mechanical strength of the first spray coating film is decreased.

Based on the above facts, it is believed that since the first spray coating films of the cylinder heads involved in Examples 1-8 contain, as the inorganic material with a layered crystalline structure (a material prone to cracking), bentonite or graphite whose area ratios fall within the range of the invention (i.e. in a range of 40% to 80%), peeling of the second spray coating film and cracking of the first spray coating film can be avoided. It should be noted that, as shown in Example 5, an effect the same as other examples was confirmed in the case of Ni containing 20% by mass of Cr.

[Result 1-3]

In terms of content of $SiO_2$ in the second spray coating film, the engine efficiency of the cylinder head involved in Comparative Example 5 was lower than those of the cylinder heads involved in Examples 1-8. It is believed that because the second spray coating film of the cylinder head involved in Comparative Example 5 contains $SiO_2$ in an amount less than 30% by mass (in particular, 20% by mass), volumetric heat capacity of the second spray coating film increases. In this regard, details will be confirmed in Confirming Test 2 described later.

Cracking of the second spray coating film occurred to the cylinder head involved in Comparative Example 6. It is believed that because the second spray coating film of the cylinder head involved in Comparative Example 6 contains $SiO_2$ in an amount exceeding 50% by mass (in particular, 60% by mass), toughness of the second spray coating film is decreased, and cracking occurs due to thermal stress.

Based on the above facts, it is believed that because the second spray coating films of the cylinder heads involved in Examples 1-8 contain $SiO_2$ within the range of the invention, i.e. in the range of 30% to 50% by mass (in particular, 33%-50% by mass), the engine efficiency is improved and cracking of the second spray coating film is avoided.

[Result 1-4]

In terms of ratio of the pores in the second spray coating film, although the second spray coating film of the cylinder head involved in Comparative Example 7 contained 33% by mass of $SiO_2$, the engine efficiency thereof was lower than those of Examples 1-8. It is believed that because the area ratio of the pores in the second spray coating film of the cylinder head involved in Comparative Example 7 is less than 30% (in particular, 25%), thermal conductivity of the second spray coating film increases.

On the other hand, cracking of the second spray coating film occurred in the cylinder head involved in Comparative Example 8. This is because the area ratio of the pores in the second spray coating film involved in Comparative Example 8 exceeds 80% (in particular, 85%), thus mechanical strength of the second spray coating film decreases.

Based on the above facts, it is believed that, in the second spray coating films of the cylinder heads involved in Examples 1-8, by allowing the second spray coating films to have an area ratio of pores in the range of 30% to 80% (in particular, 40% to 60%) relative to the sectional area of the second spray coating film, the engine efficiency can be improved while ensuring the mechanical strength of the second spray coating film. It should be noted that, details about the area ratio of pores of the second spray coating film will be confirmed in Confirming Test 3 described later.

[Result 1-5]

Figure 6B:
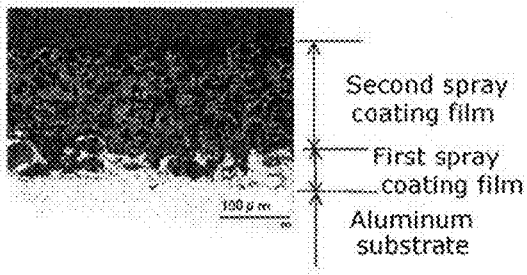
FIG. 6B is a cross-sectional photo of the spray coating film involved in Example 7.

In terms of the $ZrO_2$—$SiO_2$ powder for forming the second spray coating film, the engine efficiencies of the cylinder heads involved in Examples 7 and 8 were higher than those of the cylinder heads involved in Examples 1-6. It is believed that this is due to the fact that Example 7 employs a $ZrO_2$—$SiO_2$ powder having an average particle size smaller than those of the $ZrO_2$—$SiO_2$ powders employed in Examples 1-6 in film formation. As shown in FIG. 6B, it is believed that because the second spray coating film involved in Example 7 has increased borders between grain boundaries in comparison with those of the second spray coating films involved in Examples 1-6, consequently, small pores are increased (refined). It should be noted that, with respect to more preferable average particle size of the $ZrO_2$—$SiO_2$ powder for forming the second spray coating film, details thereof will be confirmed in Confirming Test 4 described later.

Figure 6C:
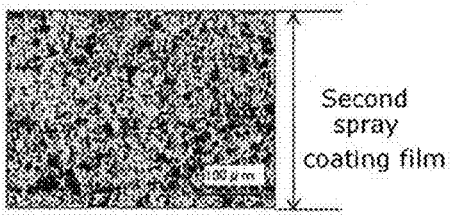
FIG. 6C is a cross-sectional photo of the spray coating film involved in Example 8.
Figure 6D:
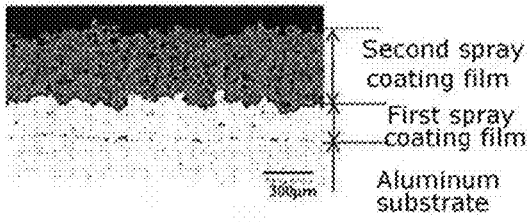
FIG. 6D is a cross-sectional photo of the spray coating film involved in Comparative Example 1.

Furthermore, the engine efficiency of the cylinder head involved in Example 8 was higher than that of the cylinder head involved in Example 7. It is believed that because a powder obtained by granulation of particles having an average particle size of 1 μm or less is used as the $ZrO_2$—$SiO_2$ powder in Example 8, as shown in FIG. 6C, borders between grain boundaries are further increased, and consequently small pores are further increased.

(Confirming Test 1)

Confirming Test 1 about area ratio of inorganic material of the first spray coating film is a test used for confirming the aforementioned Result 1-2, which confirms types of inorganic materials contained in the first spray coating film and optimum area ratio of inorganic material relative to the sectional area of the first spray coating film. In the following Reference Examples A1 to A12, the first spray coating films as shown in Table 2 were formed with the same method as in Example 1 (test bodies made of the first spray coating films were manufactured), and Young's moduli and coefficients of thermal expansion of the first spray coating films were measured by general methods.

Different from the film-forming step of the first spray coating film in Example 1, the following granulation powder was used in Reference Examples A1 to A9: an granulation powder obtained by adjusting the ratio of Ni-50Cr powder to bentonite powder in such a manner that the area ratio of bentonite relative to the sectional area of the first spray coating film was as shown in Table 2; and the following granulation powder was used in Reference Examples A10 to A12: an granulation powder obtained by adjusting the ratio of Ni-50Cr powder to graphite powder in such a manner that the area ratio of graphite relative to the sectional area of the first spray coating film was as shown in Table 2.

Figure 7A:
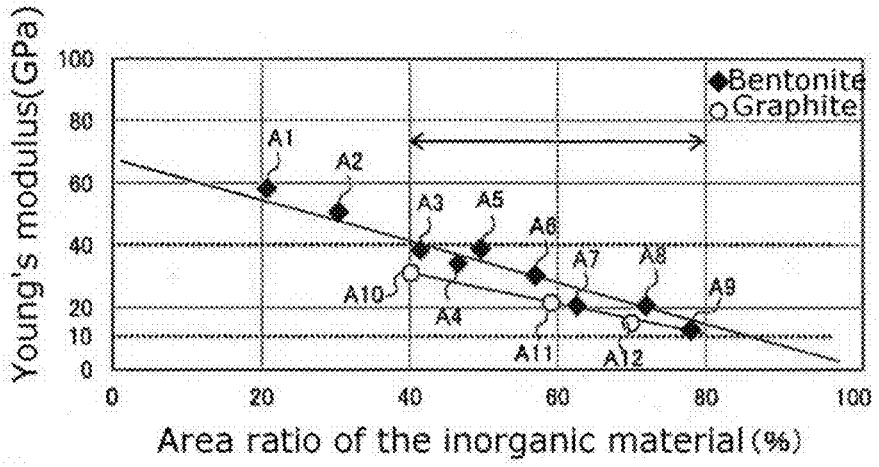
FIG. 7A is a diagram illustrating relationship between the area ratio of the inorganic material and Young's modulus of the first spray coating film involved in Reference Examples A1 to A12.
Figure 7B:
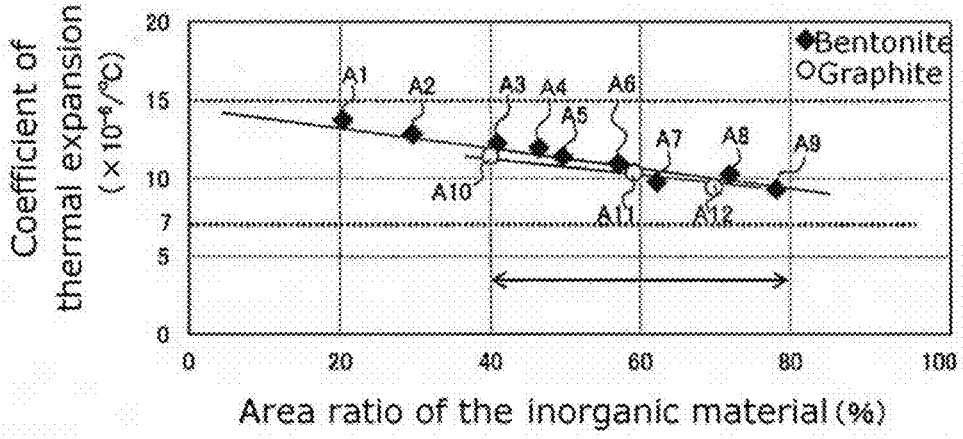
FIG. 7B is a diagram illustrating relationship between the area ratio of the inorganic material and coefficient of thermal expansion of the first spray coating film involved in Reference Examples A1 to A12.

Young's modulus and coefficient of thermal expansion of the first spray coating films in Reference Examples A1 to A12 are shown in FIGS. 7A and B. FIG. 7A is a diagram illustrating relationship between area ratio of the inorganic material and Young's modulus of the first spray coating film involved in Reference Examples A1 to A12, and FIG. 7B is a diagram illustrating relationship between area ratio of the inorganic material and coefficient of thermal expansion of the first spray coating film involved in Reference Examples A1 to A12.

TABLE 2

| | First Spray Coating Film (Intermediate Layer) | | |
|---|---|---|---|
| | Composition of Ni Alloy | Inorganic Material | Area Ratio (%) |
| Reference Example A1 | Ni—50Cr | Bentonite | 21 |
| Reference Example A2 | Ni—50Cr | Bentonite | 30 |
| Reference Example A3 | Ni—50Cr | Bentonite | 42 |
| Reference Example A4 | Ni—50Cr | Bentonite | 47 |
| Reference Example A5 | Ni—50Cr | Bentonite | 50 |
| Reference Example A6 | Ni—50Cr | Bentonite | 57 |
| Reference Example A7 | Ni—50Cr | Bentonite | 62 |
| Reference Example A8 | Ni—50Cr | Bentonite | 73 |
| Reference Example A9 | Ni—50Cr | Bentonite | 78 |
| Reference Example A10 | Ni—50Cr | Graphite | 40 |
| Reference Example A11 | Ni—50Cr | Graphite | 59 |
| Reference Example A12 | Ni—50Cr | Graphite | 70 |

[Result 2]

Herein, according to the aforementioned Result 1-2, it can be seen that the conditions for preventing the second spray coating film from peeling include (1) allowing Young's modulus of the first spray coating film to be a value lower than that of the second spray coating film (specifically, allowing Young's modulus to be 40 GPa or less), and (2) allowing the coefficient of thermal expansion of the first spray coating film (intermediate layer) to be a value between the coefficient of thermal expansion of the aluminum substrate and the coefficient of thermal expansion of the second spray coating film (specifically, a value ranging from $7\times10^{-6}$/° C. to $15\times10^{-6}$/° C.). On the other hand, the condition for preventing the first spray coating film from cracking is allowing Young's modulus of the first spray coating film to be 10 GPa or more.

As shown in FIGS. 7A and B, it can be seen that with increase in the area ratio of bentonite or graphite as an inorganic material with a layered crystalline structure, the Young's modulus and coefficient of thermal expansion of the first spray coating film decreased linearly, and both had the same trend.

Furthermore, the first spray coating films of Reference Examples A3 to A12 had Young's moduli in a range from 10 GPa to 40 GPa, and coefficients of thermal expansion in a range from $7\times10^{-6}$/° C. to $15\times10^{-6}$/° C. Thus, it is believed that if the area ratio of inorganic material relative to the sectional area of the first spray coating film is in the range from 40% to 80%, just like the first spray coating films involved in Reference Examples A3 to A12, peeling of the second spray coating film would not occur, and cracking of the first spray coating film would not occur, either.

It should be noted that, even if mica or boron nitride is used instead of bentonite or graphite, the same trend as bentonite and graphite is confirmed because these materials are inorganic materials with a layered crystalline structure.

(Confirming Test 2)

Confirming Test 2 about $SiO_2$ content of the second spray coating film is a test for confirming the aforementioned Result 1-3, which confirms optimum content of $SiO_2$ contained in the second spray coating film. In the following Reference Examples B1 to B3, the second spray coating films as shown in Table 3 were formed with the same method as in Example 1 (test bodies made of the second spray coating films were manufactured), and thermal conductivities and volumetric heat capacities of the second spray coating films were measured by general methods.

Different from the film-forming step of the second spray coating film in Example 1, as shown in Table 3, $ZrO_2$ powder free of $SiO_2$ was used to form the second spray coating film in Reference Example B1; $ZrO_2$—$SiO_2$ powder composed of $ZrO_2$—$SiO_2$ based ceramic containing 30% by mass of $SiO_2$ was used to form the second spray coating film in Reference Example B2; and $ZrO_2$—$SiO_2$ powder composed of $ZrO_2$—$SiO_2$ based ceramic containing 40% by mass of $SiO_2$ was used to form the second spray coating film in Reference Example B3, just the same as the second spray coating film in Example 4.

Figure 8:
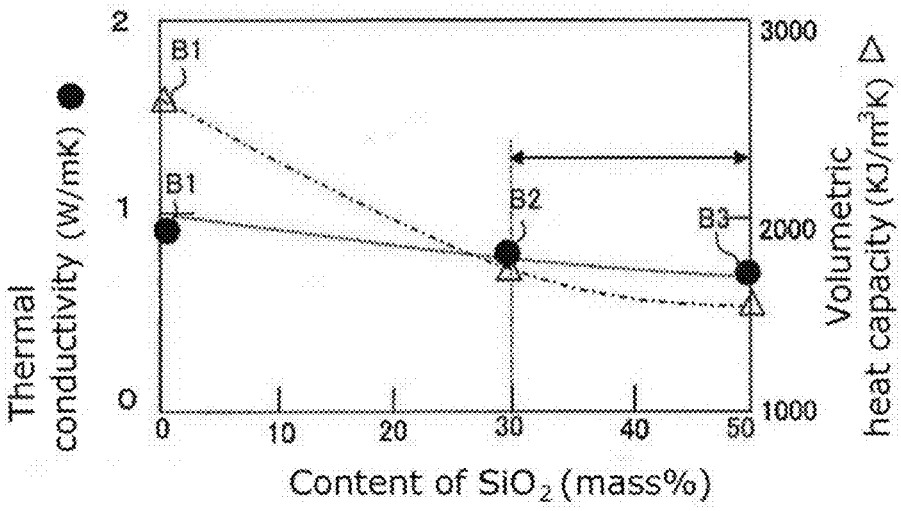
FIG. 8 is a diagram illustrating relationship between $SiO_2$ content in the second spray coating film and thermal conductivity and volumetric heat capacity of the second spray coating film involved in Reference Examples B1 to B3.

Thermal conductivity and volumetric heat capacity of the second spray coating films of Reference Examples B1 to B3 are shown in FIG. 8. FIG. 8 is a diagram illustrating relationship between content of $SiO_2$ in the second spray coating film and thermal conductivity and volumetric heat capacity of the second spray coating film involved in Reference Examples B1 to B3.

TABLE 3

| | Second Spray Coating Film (Heat Insulating Layer) | |
|---|---|---|
| | Composition | Area Ratio of Pores (%) |
| Reference Example B1 | $ZrO_2$ | 60 |
| Reference Example B2 | $ZrO_2$—$30SiO_2$ | 60 |
| Reference Example B3 | $ZrO_2$—$50SiO_2$ | 60 |

[Result 3]

Herein, as shown in the aforementioned Result 1-3, it is inferred that by containing $SiO_2$ in the second spray coating film, volumetric heat capacity can be decreased, temperature of the second spray coating film can be lowered rapidly, and engine efficiency of the cylinder head can be increased. Therefore, as shown in FIG. 8, and as demonstrated by Reference Examples B2 and B3, if the content of $SiO_2$ in the second spray coating film is 30% by mass or more, the second spray coating film can be maintained at a state of small volumetric heat capacity. In addition, it is believed that when the content of $SiO_2$ in the second spray coating film exceeds 50%, as shown in the aforementioned Result 1-3, toughness of the second spray coating film decreases, and cracking occurs due to thermal stress.

(Confirming Test 3)

Confirming Test 3 about area ratio of pores in the second spray coating film is a test for confirming the aforementioned Result 1-4, which confirms optimum area ratio of pores in the second spray coating film. In the following Reference Examples C1 to C6, the second spray coating films as shown in Table 4 below were formed with the same method as in Example 1 (test bodies made of the second spray coating films were manufactured), thermal conductivity of the second spray coating films in Reference Examples C1 to C5 was measured by general methods, and bending strength of the second spray coating films in Reference Examples C2 to C6 was measured by general methods.

Different from the film-forming step of the second spray coating film in Example 1, for Reference Examples C1 to C3, C5, and C6, spraying conditions of the amount of hydrogen gas mixed in the Ar—$H_2$ gas that serves as plasma gas, the plasma current, the plasma voltage and the like were changed such that the area ratios of pores in the second spray coating film relative to the sectional area of the second spray coating film were adjusted to be as shown in Table 4. It should be noted that, the second spray coating film involved in Reference Example C4 is the same as the second spray coating film involved in Example 1.

Figure 9:
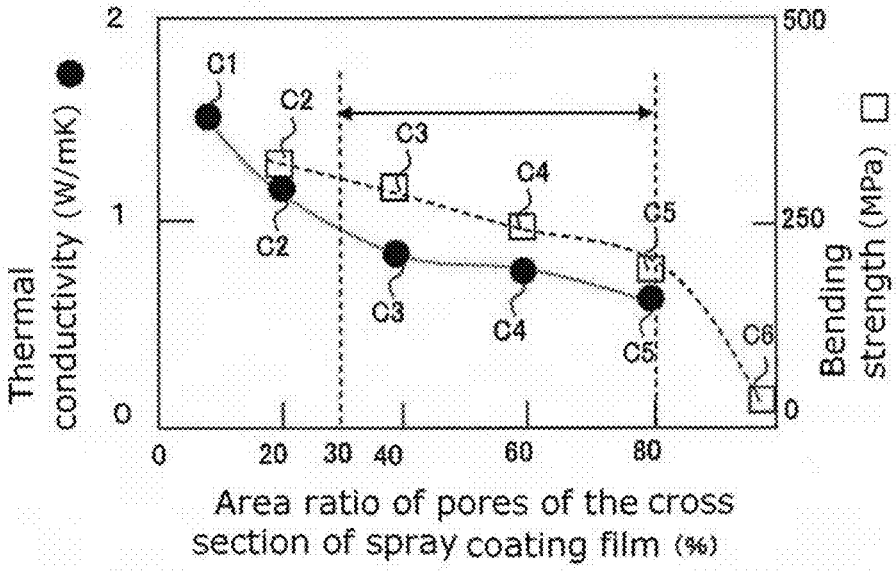
FIG. 9 is a diagram illustrating relationship between the area ratio of pores in the second spray coating film and thermal conductivity and bending strength of the second spray coating film involved in Reference Examples C1 to C6.
Figure 10A:
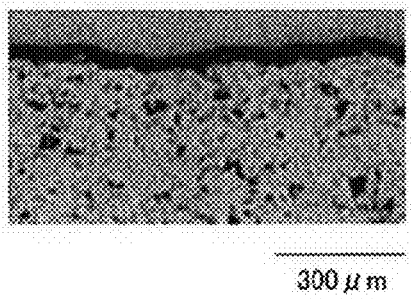
FIG. 10A is a cross-sectional photo of the second spray coating film involved in Reference Example C2.
Figure 10B:
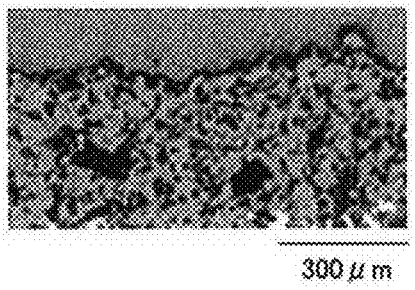
FIG. 10B is a cross-sectional photo of the second spray coating film involved in Reference Example C3.
Figure 10C:
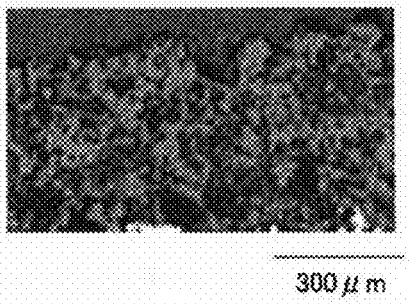
FIG. 10C is a cross-sectional photo of the second spray coating film involved in Reference Example C4.

Thermal conductivity of the second spray coating films in Reference Examples C1 to C5 and bending strength of Reference Examples C2 to C6 are shown in FIG. 9. FIG. 9 is a diagram illustrating relationship between area ratio of pores in the second spray coating film and thermal conductivity and bending strength of the second spray coating film involved in Reference Examples C1 to C6. FIG. 10A is a cross-sectional photo of the second spray coating film involved in Reference Example C2, FIG. 10B is a cross-sectional photo of the second spray coating film involved in Reference Example C3, and FIG. 10C is a cross-sectional photo of the second spray coating film involved in Reference Example C4.

TABLE 4

| | Second Spray Coating Film (Heat Insulating Layer) | |
|---|---|---|
| | Composition | Area Ratio of Pores (%) |
| Reference Example C1 | $ZrO_2$—$33SiO_2$ | 8 |
| Reference Example C2 | $ZrO_2$—$33SiO_2$ | 20 |
| Reference Example C3 | $ZrO_2$—$33SiO_2$ | 40 |
| Reference Example C4 | $ZrO_2$—$33SiO_2$ | 60 |
| Reference Example C5 | $ZrO_2$—$33SiO_2$ | 80 |
| Reference Example C6 | $ZrO_2$—$33SiO_2$ | 97 |

[Result 4]

As shown in the aforementioned Result 1-4, with increase in the thermal conductivity of the second spray coating film, the engine efficiency decreases. Here, as shown in FIG. 9, since the area ratio of pores in the second spray coating film is less than 30%, there is a trend for the thermal conductivity of the second spray coating film to be increased (e.g. with reference to Reference Examples C1 and C2). As a result, it is believed that if an area ratio of pores in the second spray coating film is 30% or more, thermal conductivity can be ensured to be 1 W/mK or less, and the engine efficiency can be increased (with reference to Reference Examples C3 to C6).

In addition, if an area ratio of pores in the second spray coating film exceeds 80%, mechanical strength of the second spray coating film decreases (e.g. with reference to Reference Example C6). As a result, it is believed that if an area ratio of pores in the second spray coating film is 80% or less, mechanical strength of the second spray coating film can be ensured (with reference to Reference Examples C1 to C5).

Based on the above facts, it is believed that the engine efficiency can be increased while ensuring the mechanical strength of the second spray coating film if an area ratio of pores in the second spray coating film relative the sectional area of the second spray coating film is in a range of 30% to 80%.

(Confirming Test 4)

Confirming Test 4 about average particle size of the $ZrO_2$—$SiO_2$ powder is a test for confirming the aforementioned Result 1-5, which confirms optimum average particle size of the $ZrO_2$—$SiO_2$ powder for forming the second spray coating film. In the following Reference Examples D1 to D5, the second spray coating films as shown in Table 5 below were formed with the same method as in Example 1 (test bodies made of the second spray coating films were manufactured), and thermal conductivity and thermal diffusivity of the second spray coating films in Reference Examples D1 to D5 were measured by general methods.

Reference Examples D1 to D3 and D5 differ from the film-forming step of the second spray coating film in Example 1 in the average particle size of the $ZrO_2$—$SiO_2$ powder for forming the second spray coating film, as shown in Table 5. The average particle size of Reference Example 4 was the same as that of the $ZrO_2$—$SiO_2$ powder used in Example 1.

Figure 11:
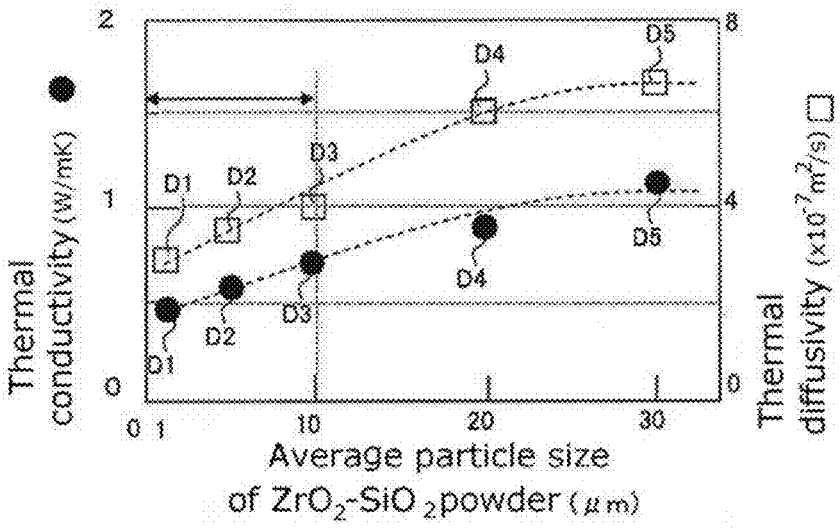
FIG. 11 is a diagram illustrating relationship between average particle size of the $ZrO_2$—$SiO_2$ powder and thermal conductivity and thermal diffusivity of the second spray coating film involved in Reference Examples D1 to D5.
Figure 12A:
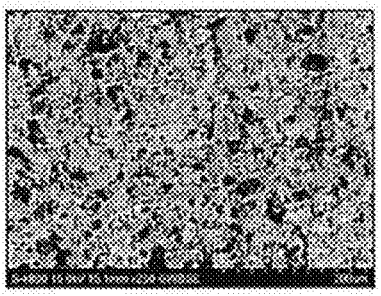
FIG. 12A is a cross-sectional photo of the second spray coating film involved in Reference Example D2.
Figure 12B:
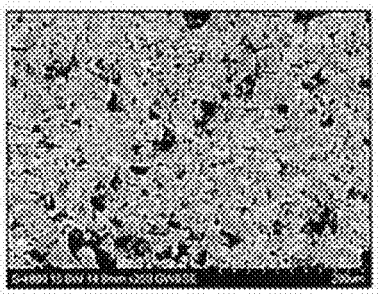
FIG. 12B is a cross-sectional photo of the second spray coating film involved in Reference Example D4.

Thermal conductivity and thermal diffusivity of the second spray coating films in Reference Examples D1 to D5 are shown in FIG. 11. FIG. 11 is a diagram illustrating relationship between average particle size of $ZrO_2$—$SiO_2$ powder and thermal conductivity and thermal diffusivity of the second spray coating film involved in Reference Examples D1 to D5. FIG. 12A is a cross-sectional photo of the second spray coating film involved in Reference Example D2, and FIG. 12B is a cross-sectional photo of the second spray coating film involved in Reference Example D4.

TABLE 5

| | Second Spray Coating Film (Heat Insulating Layer) | | |
|---|---|---|---|
| | Composition | Area Ratio of Pores (%) | Average Particle Size of $ZrO_2$—$SiO_2$ Powder (μm) |
| Reference Example D1 | $ZrO_2$—$33SiO_2$ | 60 | 1 |
| Reference Example D2 | $ZrO_2$—$33SiO_2$ | 60 | 5 |
| Reference Example D3 | $ZrO_2$—$33SiO_2$ | 60 | 10 |
| Reference Example D4 | $ZrO_2$—$33SiO_2$ | 60 | 20 |
| Reference Example D5 | $ZrO_2$—$33SiO_2$ | 60 | 40 |

[Result 5]

Herein, as shown in FIG. 11, the second spray coating film obtained by film formation from $ZrO_2$—$SiO_2$ powder having an average particle size of 10 μm or less, like Reference Examples D1 to D3, has not only reduced thermal conductivity but also reduced thermal diffusivity. It is believed that this is because borders between grain boundaries are increased and consequently small pores are increases (e.g. with reference to FIG. 12A). It should be noted that, the pores formed in the second spray coating films of Reference Examples D1 to D3 have a diameter of 20 μm or less.

Based on the above facts, it is believed that the engine efficiency is increased when the second spray coating film of cylinder head is formed with a $ZrO_2$—$SiO_2$ powder having an average particle size of 1 μm to 10 μm, like Reference Examples D1 to D3. It should be noted that, when the average particle size is less than 1 μm, sometimes it is difficult to supply the powder to a spray coating apparatus.

Embodiments of the invention are described in details in the above. However, the present application is not limited to the aforementioned embodiments, and various design and alteration can be made without deviating from the spirit of the invention recited in the claims.

What is claimed is:

1. A spray coating film comprising:

a first spray coating film formed on a surface of an aluminum substrate; and a second spray coating film formed on a surface of the first spray coating film, wherein, in the first spray coating film, an inorganic material with a layered crystalline structure is dispersed in a Ni-based alloy material, and an area ratio of the inorganic material is in a range of from 40% to 80% relative to a cross section in a film thickness direction of the first spray coating film, wherein the second spray coating film is a porous film composed of $ZrO_2$—$SiO_2$ based ceramic containing 30% to 50% by mass of $SiO_2$, and the second spray coating film has an area ratio of pores of 30% to 80% relative to a cross section in a film thickness direction of the second spray coating film, and wherein the inorganic material with a layered crystalline structure is composed of at least one of bentonite or graphite.

2. An engine having the spray coating film according to claim 1, wherein the engine has a cylinder head as the aluminum substrate, and the spray coating film is formed on a wall surface of the cylinder head that forms a combustion chamber.

3. A film-forming method of a spray coating film having a first spray coating film formed on a surface of an aluminum substrate and a second spray coating film formed on a surface of the first spray coating film, comprising:

a step of forming the first spray coating film by spray coating a surface of the aluminum substrate with a mixed powder, obtained by mixing an inorganic powder composed of an inorganic material with a layered crystalline structure and a Ni alloy powder composed of a Ni-based alloy material, in such a manner that an area ratio of the inorganic material is in a range of from 40% to 80% relative to a cross section in a film thickness direction of the first spray coating film; and a step of forming the second spray coating film by spray coating a surface of the first spray coating film with a $ZrO_2$—$SiO_2$ powder composed of $ZrO_2$—$SiO_2$ based ceramic containing 30% to 50% by mass of $SiO_2$, in such a manner that the second spray coating film has an area ratio of pores of 30% to 80% relative to a cross section in a film thickness direction of the second spray coating film, wherein the inorganic powder is composed of at least one of bentonite or graphite.

4. The film-forming method of a spray coating film according to claim 3, wherein the $ZrO_2$—$SiO_2$ powder has an average particle size in a range from 1 to 10 μm.

5. The film-forming method of a spray coating film according to claim 3, wherein the $ZrO_2$—$SiO_2$ powder is a powder obtained by granulating particles having an average particle size of 1 μm or less.

6. The film-forming method of a spray coating film according to claim 3, wherein the mixed powder is a granulation powder obtained by granulating inorganic particles that constitute the inorganic powder and Ni alloy particles that constitute the Ni alloy powder.

7. A method of manufacturing an engine by using the film-forming method of a spray coating film according to claim 3, wherein the spray coating film is formed on a wall surface of a cylinder head that forms a combustion chamber, wherein the cylinder head serves as the aluminum substrate.

* * * * *